United States Patent [19]

Wade

[11] Patent Number: 4,848,055

[45] Date of Patent: Jul. 18, 1989

[54] CENTER MOUNTED INSULATING MODULE FOR A FURNACE

[75] Inventor: James A. Wade, Salina, Okla.

[73] Assignee: A. P. Green Industries, Inc., Mexico, Mo.

[21] Appl. No.: 192,061

[22] Filed: May 9, 1988

[51] Int. Cl.[4] ..... E04B 1/80

[52] U.S. Cl. ..... 52/506; 52/509; 52/513; 52/593

[58] Field of Search ..... 52/506, 509, 511, 512, 52/513, 585, 593, 747; 411/508–510, 913; 24/573; 110/336–339

[56] References Cited

U.S. PATENT DOCUMENTS

| | | | |
|---|---|---|---|
| 3,742,670 | 7/1973 | Byrd, Jr. | 52/506 |
| 4,177,616 | 12/1979 | Lampert | 52/509 |
| 4,233,468 | 11/1980 | Northrup, Jr. | 52/506 X |
| 4,494,295 | 1/1985 | Herring | 52/506 X |
| 4,584,814 | 4/1986 | Hounsel et al. | 52/506 X |

*Primary Examiner*—David A. Scherbel
*Assistant Examiner*—Richard E. Chilcot, Jr.
*Attorney, Agent, or Firm*—Senniger, Powers, Leavitt and Roedel

[57] ABSTRACT

A center mount module of ceramic fibers having internal hardware adapted to engage a prior art anchor stud and guide the module into place on the internal wall of a furnace. The module may be a plurality of edge stacked mats or loop folded mats; the edge grain forms both the hot and the cold face of the installed module in the former case whereas, in the latter, either the loops or the edge grain may form the cold face but a looped cold face is preferred. The mats are joined together by an elongate tine having a central hole therein and lying in a plane between and substantially parallel to the hot and cold faces of the module. A notched tube disposed between adjacent mats straddles the tine in co-axial relationship with the central hole of the tine.

14 Claims, 3 Drawing Sheets

CENTER MOUNTED INSULATING MODULE FOR A FURNACE

FIELD OF THE INVENTION

This invention relates to a ceramic fiber module equipped for quick and easy mounting on a furnace wall. More particularly, it relates to a center mounted module which is compressed against the furnace wall by the mounting operation to block the passage of gases from the interior of the furnace to the furnace wall.

BACKGROUND OF THE INVENTION

Ceramic fibers modules have replaced insulating firebrick as the material of choice for lining heat treating furnaces , ceramic kilns, brick kilns and other kinds of furnaces. Blankets of alumina-silica fibers are cut into strips or folded and edge-stacked to form the modules which can then be attached to the shell of a furnace by anchors, pins, cement or a combination of these and other means.

Although such edge grained modules are advantageous because of their light weight, ease of handling, and adaptability, the nature of their construction poses certain problems such as opening of the seams upon shrinkage at high temperature. The passage of corrosive gases from the interior of the furnace through such open seams to the furnace wall will shorten the life of the furnace. Also, the difficulty in hiding the attachment hardware away from such corrosive gases while keeping it accessible to the installer's hands is generally recognized.

Several module designs and retaining systems have been proposed to utilize the advantages and make it easier to install the modules in a furnace. Finney, in U.S. Pat. No. 4,516,374, teaches an intermodular mounting system wherein an elongated retainer bar extends laterally through a module and is supported at each end by bifurcated supports extending inward from the furnace wall along opposite margins of the module. The fingers of the bifurcated supports are bent toward each other to grip end portions of retainer bars projecting from adjacent modules and must be pried apart to release the bars when a module is to be removed.

In U.S. Pat. No. 4,574,995, Sauder et al teaches the parquet arrangement of a plurality of edge-grained ceramic fiber modules to minimize the occurrence of cracks resulting from the high temperature shrinkage of the fibers. A supporting member embedded in the cold face of a module extends through a block of backing type insulation and is welded to the furnace wall by pushing a welding gun through the module until it finds and engages the supporting member and triggering the gun.

Pickles, in U.S. Pat. No. 4,157,001, teaches an anchoring system for insulating material on a high temperature furnace wall wherein a stud having a plurality of anchor-engaging notches is attached to the wall and a first anchor having an open, tapered cavity therein is pushed axially over the projecting end of the stud and through the insulating material to engage a first pair of notches on the stud and hold the material between the anchor and the wall. A second anchor is partially inserted axially into the cavity of the first anchor to engage a second pair of notches on the stud more distant from the wall than the first pair.

Herring, in U.S. Pat. No. 4,494,295, teaches a furnace wall lining system wherein a plurality of brackets, each having its free end bent into a loop, is welded to the furnace wall according to a predetermined pattern to accommodate the required number of ceramic fiber modules, a module is then laid against the wall and next to a bracket, and a retainer pin is pushed through the loop of the bracket and into the module as far as a stop on the pin will allow. Another module is then impaled on the portion of the retainer pin which still sticks out of the loop and the sequence is repeated. The first and last module in each course must be impaled on pins projecting from the end walls of the furnace.

A retainer assembly for securing a ceramic fiber blanket against a furnace wall is taught by Hanson et al in U.S. Pat. No. 4,576,532. The assembly consists of a notched, elongated stud having a longitudinal slit and a retainer plate which engages the notches of the stud. A bend in the stud and the slit form a pair of laterally offset fingers having alternate teeth and notches opposite the slit. When an array of studs is welded to the furnace wall, a blanket is impaled on them and made to lie against the furnace wall. The retainer plates each have a central opening whereby they are slidably received by the studs whose fingers move in a scissor-like fashion as the plates are urged along the studs toward the blanket. When a plate is in the desired position against the blanket and with respect to the notches, the fingers are allowed to scissor back toward their original position whereby the plate is locked in that position by the teeth on the fingers. The bifurcated stud of Hanson et al is used in a novel combination with a tine in the invention described and claimed herein. Although the stud is described herein below in association with the other features of this invention, the description of the stud in U.S. Pat. No. 4,576,532 is incorporated herein by reference.

SUMMARY OF THE INVENTION

Basically, the invention comprises a center mount module of ceramic fibers having internal hardware adapted to engage the anchor stud of U.S. Pat. No. 4,576,532 and guide the module into a place on the internal wall of a furnace. The module may be a plurality of edge stacked mats or loop folded mats; the edge grain forms both the hot and the cold face of the installed module in the former case whereas, in the latter, either the loops or the edge grain may form the cold face but a looped cold face is preferred. The mats are joined together by an elongate tine having a central hole therein and lying in a plane between and substantially parallel to the hot and cold faces of the module. A notched tube disposed between adjacent mats straddles the tine in co-axial relationship with the central hole of the tine.

Said module in combination with the anchor stud of the U.S. Pat. No. 4,576,532 provides a novel system for installing insulation on a furnace wall that retains all of the advantages of the center mounted modules known before this invention while eliminating some of the disadvantages and affording new advantages to the insulation installer and to the operator of the furnace.

It is an object of this invention to provide a center mounted module that may be compressed more tightly against the furnace wall than any module heretofore known to me.

It is another object of this invention to provide a center mounted module that is not only easy to install but easy to remove when replacement is necessary.

It is a related object of this invention to provide a center mounted module that may be installed more quickly in a predetermined pattern than any known to me before my invention described and claimed herein.

It is a further object of this invention to provide a center mounted module anchoring system whereby a back-up blanket may be easily installed before the modules are put into place.

It is a related object of this invention to provide a center mounting system whereby the weldments for the anchoring studs may be checked visually before the modules are installed.

It is a still further object of this invention to provide a system for the center mounting of ceramic fiber modules whereby the modules and their internal hardware may be visually guided onto each of an array of anchoring studs projecting from the furnace wall.

It is yet another object of this invention to provide a center mounted ceramic fiber module that may be trimmed drastically in appropriate situations despite the presence of internal hardware.

DETAILED DESCRIPTION OF THE INVENTION

Figure 1:
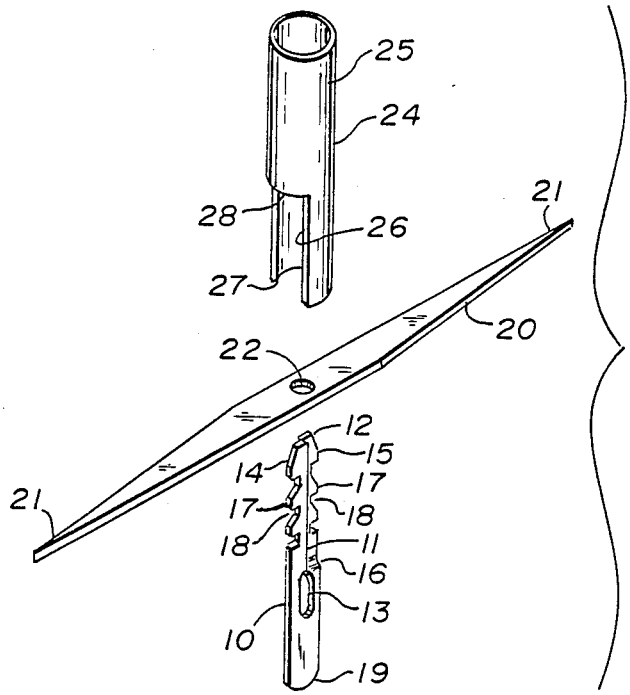
FIG. 1 is an exploded view in perspective of the mounting system of this invention.

In FIG. 1, the metal anchor stud 10 has the slit 11 extending from the inner end 12 to the oval hole 13 and is thereby bifurcated into the first finger 14 and the second finger 15. A double bend 16 in the second finger causes the two fingers to be laterally offset from one another and allows the fingers to be moved in a scissor like fashion. The equal length of the fingers 14 and 15 and the indicated alignment of the teeth 17 and the notches 18 on the two fingers result from a compensation for the double bend 16 when the stud is stamped from a metal blank. When the stud 10 is welded to the inner wall of a furnace, an arc is truck at the tip 19, which will be the outer tip relative to the interior of the furnace.

The tine 20 has a skewed diamond shape with a pointed tip 21 at each longitudinal end and central hole 22. The cylindrical wall 24 of the tube 25 has a pair of diametrically opposed notches 26. The notched end 27 is adapted to straddle the tine 20 in substantially co-axial relationship with the central hole 22 of the tine. The distance between the end 27 and the upper boundary 28 of each notch 26 is determined by the length of the stud and the desired displacement of the tine 20 along the serrated edges of the fingers 14 and 15.

Figure 2:
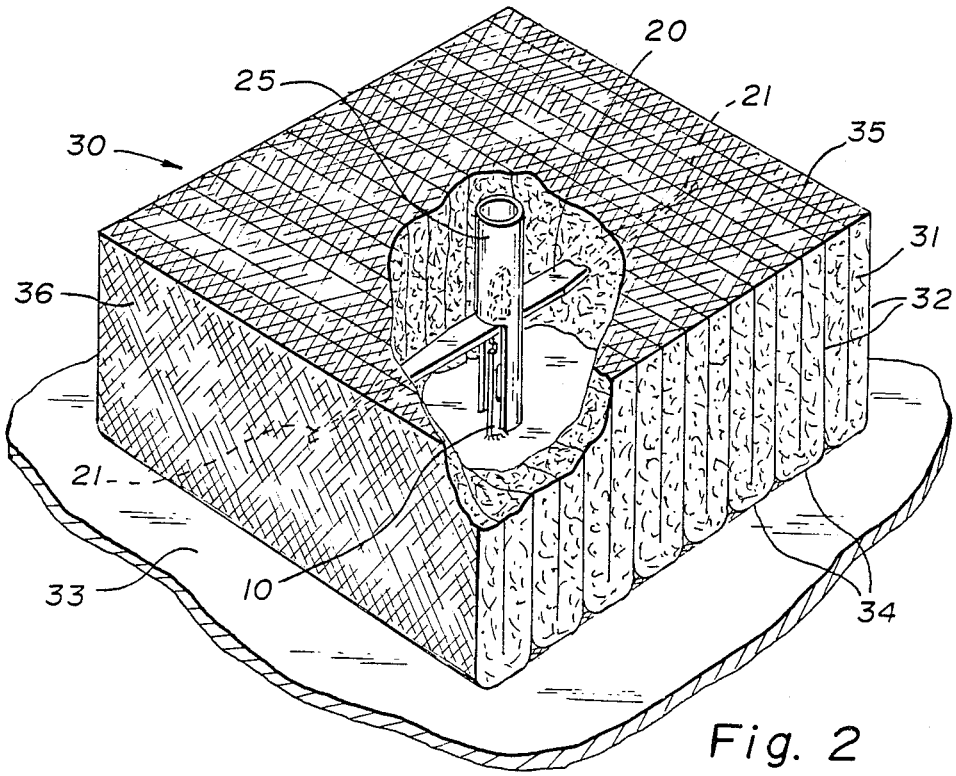
FIG. 2 is a partially cut away perspective view of the center mounted module of this invention on a portion of a furnace wall.

In FIG. 2, the module 30 comprises a plurality of the loop folded mats 31, the major surfaces 32 of which are perpendicular to the cold face of the module compressed against the furnace wall 33. In this preferred embodiment, the loops 34 make up the cold face while the edge grain 35 opposite the loops is at the hot face of the module. The module is held together under compression by the net wrapper 36 but cutting of the wrapper after installation of the module allows expansion so that adjacent modules are tightly packed together. Each module 30 is constructed by mounting the tine 20 on the upright support jig which passes through the hole 22, resting the upper boundaries 28 of the tube notches 26 on the tine so that the tube 25 is substantially co-axial with the hole 22, and impaling half of the loop folded mats 31 on each tip 21 of the tine. The wrapped module is installed on the stud 10 by visually aligning the tube 25 and the central hole 22 of the tine over the stud and pushing the tube against the tine which causes the fingers 14 and 15 to scissor together and allow the hole 22 to pass the teeth 17 until the desired compression is achieved. Release of the pushing force allows the fingers to scissor back so that the tine slips into the notches 18 in the fingers.

Figure 3:
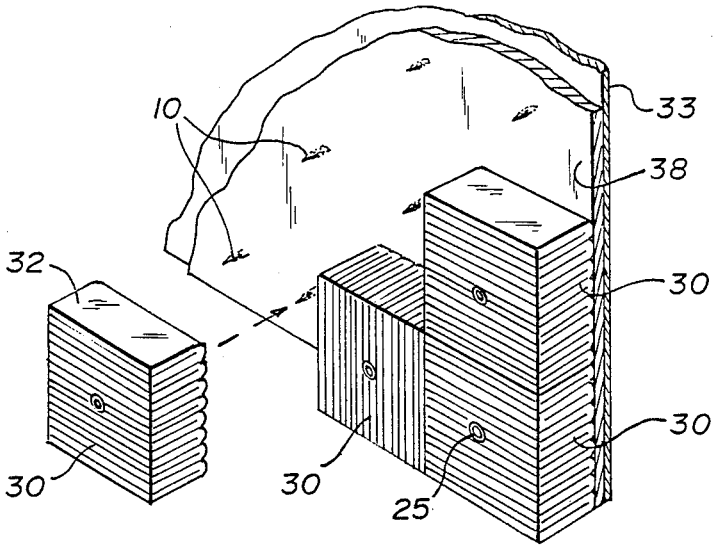
FIG. 3 is a fragmentary perspective view of an insulated wall of this invention showing various stages of the insulation method of this invention.
Figure 5:
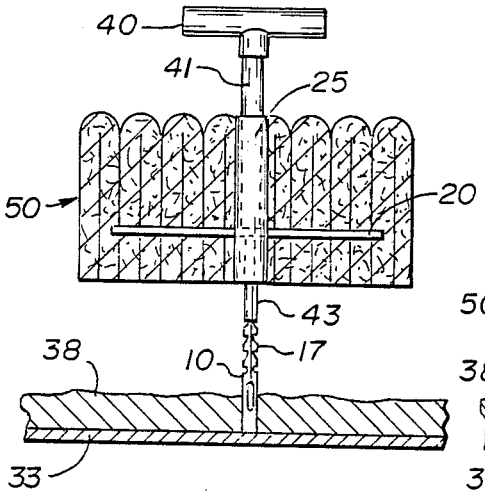
FIGS. 5 and 6 are cross sections of a module being installed on a furnace wall with the aid of the tool of FIG. 4.
Figure 6:
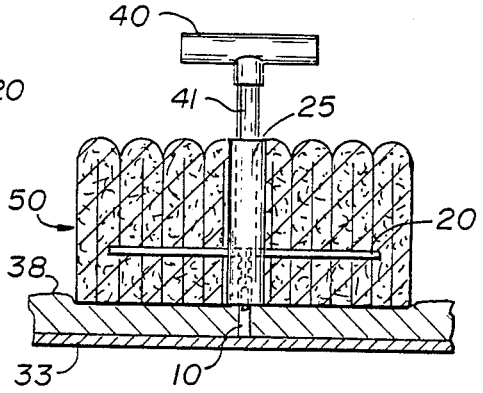

In FIG. 3, the studs 10 are welded to the furnace wall 33 in a predetermined pattern and the back-up blanket 38 is impaled on them to cover the wall. A parquet arrangement of the modules 30 may be achieved easily and quickly by turning every other one through 90° on the axis of the central hole 22 and compressing each module tightly against the blanket 38 by pushing on the tine 20 with the tube 25 or as shown in FIGS. 5 and 6. When the modules border an opening as shown here, the tines in each border module are parallel to the edge of the opening.

Figure 4:
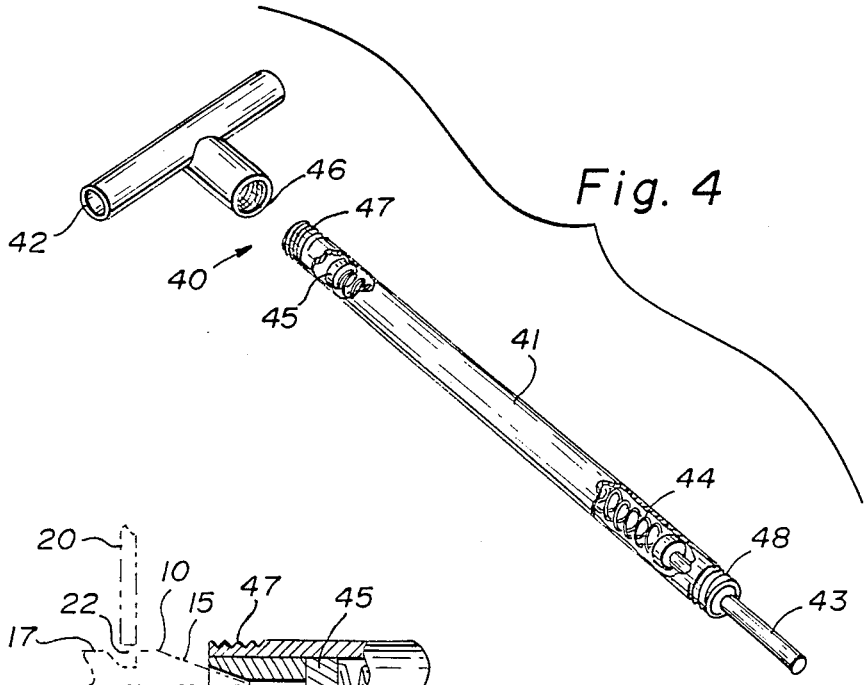
FIG. 4 is a perspective view of a tool for the installation and removal of a module of this invention.
Figure 4A:
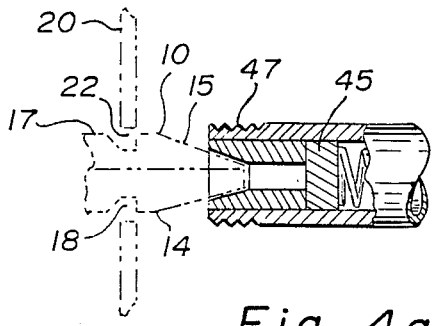
FIG. 4*a* is a perspective view of the tool, partially cut away, in its removal mode.

A quick module installation and removal is achieved with the tool 40 which consists of the pipe 41 and the T handle 42 as shown in FIG. 4. At the installation end of the pipe 41, the telescoping tube 43 is attached to the spring 44 which extends through the pipe to the bushing 45. The outside diameter of the tube 43 is smaller than that of the hole 22 and the inside diameter is such that the tube 43 will cause the fingers 14 and 15 to scissor toward each other when it is pushed onto the stud 10. The bushing 45 in the pipe at the end opposite the tube 43 also has an inside diameter appropriate to that scissoring function when the tool is used for the removal of a module 30. In the installation mode of the tool 40, the internal threads 46 of the handle 42 are screwed onto the threads 47 of the pipe whereas the handle is screwed onto the threads 48 in the removal mode, as shown in FIG. 4*a*. The stud 10 and the tine 20 impaled thereon are shown by phantom lines in FIG. 4*a* as if they were in a module 30. The bushing 45 has compressed the fingers 14 and 15 toward each other to allow the hole 22 of the tine to pass by the teeth 17 and the module can be pulled clear from the stud.

Figure 7:
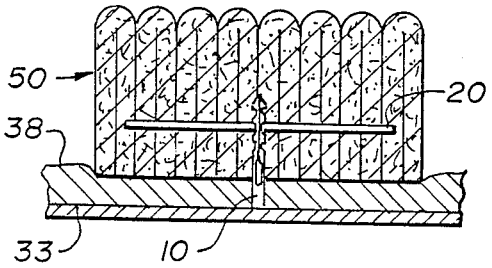
FIG. 7 is an elevation of a module and blanket in gas tight contact with a furnace wall.

In FIG. 5, the module 50 differs from the module 30 in that the loop folds 34 of the mats 31 make up the hot face 51 of the module instead of the cold face. To install the module 50, the tool 40 is passed into the tube 25 and the telescoping tube 43 is passed through the hole 22 of the tine 20 and onto the stud 10. As the pipe 41 is pushed against the tine, the tube 43 telescopes into the pipe as shown in FIG. 6 and squeezes the fingers 14 and 15 together to allow the teeth 17 to pass through the hole 22. After the module 50 is compressed against the blanket 38 by the force applied to the tool 40, the tool and the tube 25 are removed to provide a gas tight insulating lining for the furnace wall 33, as shown in FIG. 7.

Figure 8:
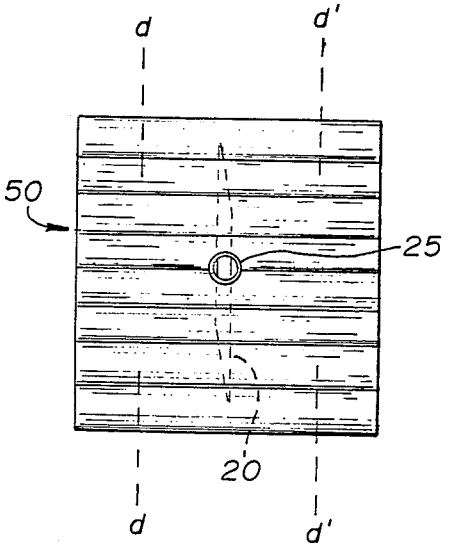
FIG. 8 is a top view of a module of this invention.

Another advantage of the center mounted module of this invention is its trimmability to as little as about 40% of its original size without affecting its function. The extent of trimming possible is shown by the lines dd and d'd' in FIG. 8. Assuming that the module 50 is square, 12 inches on each side, the lines dd and d'd' are each about 3.5 inches inboard from the respectively adjacent edges which are generally parallel to the tine 20. Trimming may be along lines parallel to said edges or at an acute angle between one of said edges and the line dd or line d'd'.

Several embodiments and aspects of the invention having been described, the subject matter claimed is:

1. A ceramic fiber module independent of but adapted for quick and easy installation on the interior wall of a high temperature furnace; said module having major surfaces and a hot face and a cold face in parallel relationship; said module comprising:

a plurality of ceramic fiber mats having their major surfaces perpendicular to the hot and cold faces;

an elongate tine having a central hole therein, said tine impaling each of the mats in a plane parallel to the hot and cold faces; and a tube having an annular wall and having diametrically opposed notches in said wall, said tube disposed between adjacent mats in a straddling relationship with the tine and in a co-axial relationship with the central hole in the tine.

2. The module of claim 1 wherein the tube extends throughout substantially the entire distance between the hot and cold faces.

3. The module of claim 1 wherein the tube is disposed at the center of the module.

4. The module of claim 1 wherein the ceramic fiber mats are loop folded mats, thereby providing an edge grain face and a looped face.

5. The module of claim 4 wherein the looped face is the cold face.

6. A system for insulating the walls of a furnace comprising:

an elongate stud attached to the furnace wall and projecting inwardly into the furnace, said stud having an inner end, an outer end, and longitudinal sides and having an elongate slit extending from said inner end thereof and a pair of elongate fingers formed by the slit, said stud being bent at the end of the slit proximate to the furnace wall whereby the fingers are laterally offset from each other, the fingers having laterally extending teeth alternating with recessed notches along the longitudinal sides opposite the slit; and a ceramic fiber module, said module having major surfaces and a hot face and a cold face in parallel relationship; said module comprising:

a plurality of ceramic fiber mats having their major surfaces perpendicular to the hot and cold faces;

an elongate tine having a central hole therein, said tine impaling each of the mats in a plane parallel to the hot and cold faces; and a tube having an annular wall and having diametrically opposed notches in said wall, said tube disposed between adjacent mats in a straddling relationship with the tine and in a co-axial relationship with the central hole in the tine, said module being said module being centrally mounted on said stud, the hole defining portion of the tine being disposed in opposing notches on the fingers.

7. The system of claim 6, wherein the tube extends throughout substantially the entire distance between the hot and cold faces of the module.

8. The system of claim 6 wherein the module is compressed against the furnace wall by the disposition of the tine along the laterally offset fingers toward the furnace wall so as to prevent the passage of gases from the furnace between the cold face of the module and the furnace wall.

9. The system of claim 6 wherein the ceramic fiber mats are loop folded mats, thereby providing an edge grain face and a looped face.

10. The system of claim 9 wherein the looped face is the cold face.

11. A method for insulating a furnace wall comprising:

(a) attaching an array of elongate, bifurcated studs to the wall in an inwardly projecting relationship to the furnace, each stud having a pair of laterally offset, parallel, elongate fingers, the outer longitudinal edges of the fingers being serrated;

(b) mounting an elongate tine having a central hole therein on a support, impaling a plurality of edge grained mats of ceramic fiber on each end of the tine, inserting a tube having diametrically opposed notches in its wall between two mats so that the tube straddles the tine and is co-axial with the central hole of the tine;

(c) placing the hole of the tine over the fingers of a stud and pushing the tine onto the stud to cause the margin of the hole to frictionally engage the serrated edges of the fingers and displace the fingers toward each other until the tine is at a predetermined distance from the furnace wall; and (d) repeating steps (b) and (c) until the desired coverage of the furnace wall is achieved.

12. The method of claim 11 wherein the tine is pushed along the stud by pushing the tube against it.

13. The method of claim 11 wherein the tine is pushed along the stud until the module is compressed against the furnace wall to close off passageways for gases from the interior of the furnace to the furnace wall.

14. A method for the removal of a ceramic fiber module from the wall of a furnace wherein the module is an edge grained block of ceramic fiber mats pierced by and joined face to face by a tine having a central hole therein and the module is mounted on the furnace wall by the engagement of the hole defining portion of the tine with a bifurcated anchor stud attached to the wall and having a pair of laterally offset, scissor-like fingers having alternating teeth and notches along the outer edges of each finger, said hole defining portion being disposed in opposite notches between successive teeth, said method comprising:

inserting a pipe through the central hole between two mats and onto the opposed teeth of the stud fingers, pushing the pipe toward the furnace wall to displace the fingers toward each other until the tine is free to pass over the teeth, and pulling the module away from the furnace wall.

* * * * *